US005568668A

United States Patent [19]

Margolin

[11] Patent Number: 5,568,668

[45] Date of Patent: Oct. 29, 1996

[54] PUSH BROOM HANDLE

[76] Inventor: Michael Margolin, 2 Autumn Dr., East Northport, N.Y. 11731

[21] Appl. No.: 506,808

[22] Filed: Jul. 25, 1995

[51] Int. Cl.[6] ..... A46B 15/00

[52] U.S. Cl. ..... 15/176.3; 15/146; 15/159.1; 15/175; 15/143.1; 15/145

[58] Field of Search ..... 15/143.1, 145, 15/146, 159.1, 171, 175, 176.1–176.6, 202

[56] References Cited

U.S. PATENT DOCUMENTS

| | | | |
|---|---|---|---|
| 428,696 | 5/1890 | Rolls . | |
| 454,757 | 6/1891 | Newbaker . | |
| 1,073,034 | 9/1913 | Ford . | |
| 1,114,617 | 10/1914 | Jabant | 15/146 |
| 1,259,245 | 3/1918 | Kessler et al. | 15/176.6 |
| 1,595,901 | 8/1926 | Mahler . | |
| 1,983,923 | 12/1934 | Stevens et al. | 15/176.3 |
| 3,188,671 | 6/1965 | Kane . | |
| 4,068,346 | 1/1978 | Binder | 16/110 R |
| 4,091,579 | 5/1978 | Giangiulio . | |
| 4,194,259 | 3/1980 | Bauman | 15/146 |
| 4,285,096 | 8/1981 | Swaim | 16/114 R |
| 4,293,972 | 10/1981 | Pomares | 15/145 |
| 4,384,383 | 5/1983 | Bryant | 15/159.1 |
| 4,499,626 | 2/1985 | Schneider | 15/146 |
| 4,538,318 | 9/1985 | Lammert et al. | 15/171 |
| 4,541,139 | 9/1985 | Jones et al. | 15/171 |
| 4,722,634 | 2/1988 | Malish | 403/299 |
| 4,763,378 | 8/1988 | Drumm | 15/146 |
| 4,785,489 | 11/1988 | Von Doehren | 15/111 |
| 5,094,564 | 3/1992 | Tedrick | 403/373 |
| 5,123,138 | 6/1992 | Flamm | 15/146 |
| 5,319,822 | 6/1994 | Shaw | 15/145 |
| 5,371,916 | 12/1994 | Vosbikian | 15/176.2 |

FOREIGN PATENT DOCUMENTS

| | | | |
|---|---|---|---|
| 1196596 | 11/1959 | France | 15/176.1 |
| 117966 | 12/1926 | Switzerland | 15/145 |

*Primary Examiner*—Mark Spisich
*Attorney, Agent, or Firm*—Alfred M. Walker

[57] ABSTRACT

A broom handle includes a fastener for a broom bristle block, wherein a rod handle is attached to the broom bristle block by a bent fastener brace which includes a first mid plate and a wide central arcuate second portion attached to the handle, as well as a bent pleat member. The plane of the fastener is folded about itself at an angle for insertion of the broom therein on one side. On an opposite side the fastener is attached to the top of the bristle block. The fastener has a wide reverse pleat member formed from a reverse pleat folded in a reverse direction and extending downward vertically at right angles to the middle plate portion, to transfer forward pushing force away from a downward direction and to a horizontally aligned direction parallel to the movement of the broom.

7 Claims, 3 Drawing Sheets

PUSH BROOM HANDLE

FIELD OF THE INVENTION

The present invention relates to push brooms and handles provided for same.

BACKGROUND OF THE INVENTION

Various attempts have been to improve push brooms, wherein a bristle block is provided with a plurality of bristles extending therefrom, and wherein a handle rod is provided at an angular relationship with relation to the bristle block by means of an insertable threaded stem portion.

A typical prior art push broom is shown in drawing FIG. 1, labeled "Prior Art" herein. The rod is threadably screwed into a corresponding threaded recess, and placed at an angle, within the bristle block portion.

The disadvantages of these prior art push brooms are that after time and use, the handle rods loosen and wear out, so that the handle rod can never be completely tightened. After repeated use, the user is compelled to constantly re-tighten the handle rod, often as frequently as one tightening time for each sweep of the broom, when the rod is especially loose.

Another disadvantage of prior art push brooms is that because of the nature of the contact of the bristles during a sweep, the downwardly extending bristles bend under each other in arcuate fashion, thereby causing the bottom lower portion of the bristles to rotate about themselves, so that the upper portion of the bristles rotate along an arc, causing the bristle head, and therefore the broom handle to rotate upwardly outwardly away from the user.

This is especially a problem where the bristles stick to sticky surface, such as a hot roof. This nature of the bristles to move is uncomfortable for a broom user, and the rotation of the bristles causes the broom to become temporarily stuck or to pull upward against the arms of the user in an unnatural uncomfortable fashion.

Various attempts have been made to stabilize the handle above the bristle block by providing a sleeve attached by extension members or by other means.

Among these prior patents include U.S. Pat. No. 454,757 of Newbaker, dated Jun. 23, 1891, which describes a broom which has an "L" shaped brace, when viewed from the side, with a flat bottom portion. A connecting fastener connects the "L" shaped brace with the handle. When viewed from the front, the "L" shaped brace has an arcuate rounded shape, except for the fact that the arch is much higher than it is wide. Therefore it only attaches to the bristle block in a center portion thereof.

While the broom in U.S. Pat. No. 4,293,972 of Pomares is of a different structure, it does show a brace which is connected by wing nuts to a broom head.

Also, Malish Patent no. 4,722,634 shows a handle being inserted in a sleeve, attached to the broom head.

While the broom in U.S. Patent 4,785,489 of Von Doehren has a flexible spring to make the broom handle resilient, a triangular brace is attached by bolts to a broom head block.

Furthermore, U.S. Pat. No. 4,763,378 of Drumm shows a modified broom head wherein a handle is attached by a brace with a wing nut. The same is true for U.S. Pat. No. 5,094,564 of Tedrick and U.S. Pat. No. 1,073,034 of Ford.

U.S. Pat. No. 4,194,259 of Bauman described a handle, which is a separate piece from the handle sleeve, which is further separate from a collection of triangular prongs, which prongs are separate from the brace. This makes it a complicated attachment means with many parts, which are further attached solely to the top of the broom bristle block, thereby not addressing the folding and rotating outward of the bristle portions of the bristle block.

The earlier prior art patents do not address the problem of the rotation of the bristles upon contact with a ground portion, causing the broom to "trip" over itself, so that the bristle block, instead of proceeding laterally parallel to the ground being sweep, tends to rotate up and away from the user, in an uncomfortable manner.

OBJECT OF THE INVENTION

It is therefore an object of the present invention to provide a push broom with a handle which does not loosen.

Another object of the present invention is to provide a broom handle and block fastening device which maintains the handle rod in a sturdy locked position above the block.

It is yet another object to provide a broom handle with a fastener which provides a means to counteract the rotational movement of the bristles when pushed.

It is yet another object to improve over the disadvantages of the prior art.

SUMMARY OF THE INVENTION

In keeping with these objects and others that may become apparent, the present invention comprises a broom handle which is fastened to a bristle block, wherein the handle comprises a linear handle rod portion, which rod is truncated at one end, to accommodate the rod in an angular position with relation to the top of the bristle block. The handle is attached by means of a novel bent fastener brace, which includes a first middle plate attached to a bristle block, and a wide central arcuate second portion attached to the handle rod, as well as a third portion with a reverse bent pleat, wherein the plane of the fastener is folded about itself at an angle for insertion of the broom therein on one side.

The third wide plate portion is formed from a reverse pleat folded in a reverse direction from the fold of the second, arcuate portion up from the middle plate. The third wide plate portion extends downward vertically at right angles to the middle plate portion to provide a means of transferring forward pushing force, away from a downward direction, and toward a horizontally aligned direction, parallel to the movement of the broom.

By virtue of the vertically aligned third wide plate portion pushing against substantially all of a rear vertical wall of the bristle block, the third plate facilitates the horizontal movement of the bristle block.

The configuration of the fastener counteracts any rotational movement of the bristles, caused by misplacing the force applied upon the handle from a downward direction, to a more horizontally aligned direction in alignment with the preferred movement of the broom along the ground of the floor being swept.

The fastener is constructed from a generally rectangular plate of rigid material, such as plastic or steel, which material further generally includes a rounded upper portion joinable to the broom handle rod.

Two of the edges of the fastener have pleats, namely, the upward pleat portion and the downward reverse pleat portion. The pleats are formed by folding one of the edges of the first middle plate and then a substantial portion of the fastener is folded back on itself, so that a portion of the inner surface of the material is folded in a reverse direction from the first pleat.

The purposes of the two folded pleats are to generally provide that when the fastener is installed upon the broom bristle block, the pleats are folded in a set position to hold the block in a position to facilitate the horizontal movement of the broom when being swept.

Once the pleats have been formed in the fastener, the middle plate is provided with apertures for attaching the block of the bristle block of the broom by means of screws or wing nuts or other fastening means.

When installed on the back wall of the bristle block, the reverse pleat portion is folded to create a pocket like corner recess for abutting the rear upper corner of the bristle block therein, to accommodate the same. Therefore, the folded plate fastener conforms to the shape of the upper rear block of the bristle block.

At the opposite first upward pleat, the middle plate is folded upward away from the top of the bristle block and towards the angular position of the handle rod, which rod is secured at the middle of the fastener, within the recess formed under the first outwardly extending arcuate plate portion and the horizontal middle plate portion. The rear reverse plate forms the vertical abutment for the rear corner and rear vertical edge of the bristle block.

Because of the position of the reverse pleat portion, a positive force can be applied, not only downward against the top of the bristle block, but also horizontally against substantially all of the width of the rear of the bristle block.

The pleating arrangement serves to hold the bristle block in a preferred position, which increases the comfort of using the broom, since it counteracts any rotating "tripping" force of the bristles against each other away from the user.

DESCRIPTION OF THE DRAWINGS

The present invention may be best understood in conjunction with the accompanying drawings in which.

DETAILED DESCRIPTION OF THE PREFERRED EMBODIMENT

Figure 3:
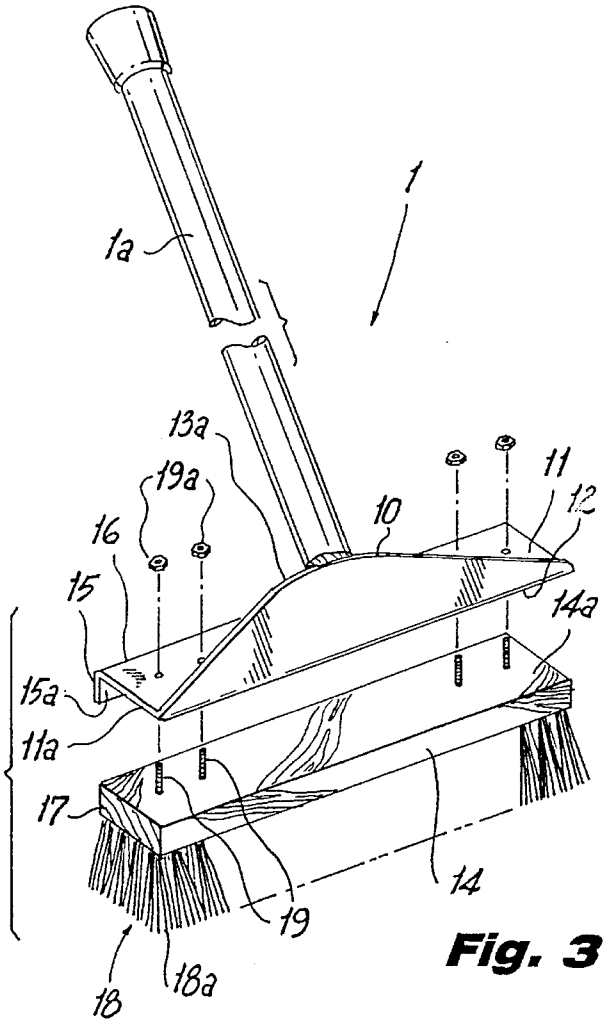
FIG. 3 is an exploded perspective view thereof.
Figure 2:
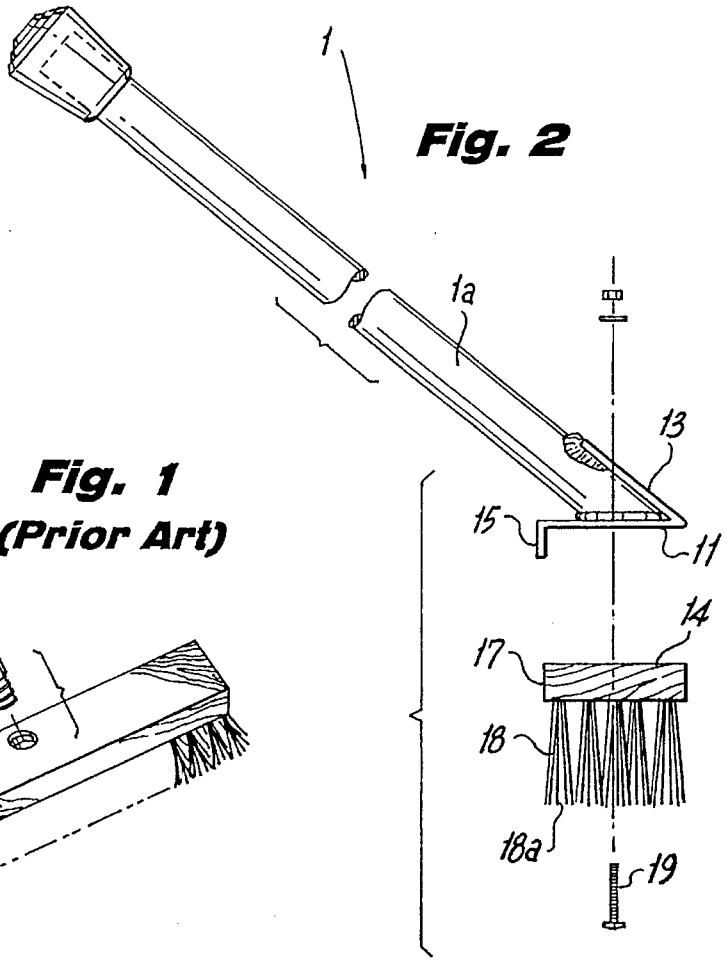
FIG. 2 is a left side elevational view of a push broom and handle combination of the present invention.

Reference to be made to the drawing figures, wherein the drawings will be designated with like numerals throughout.

Figure 1:
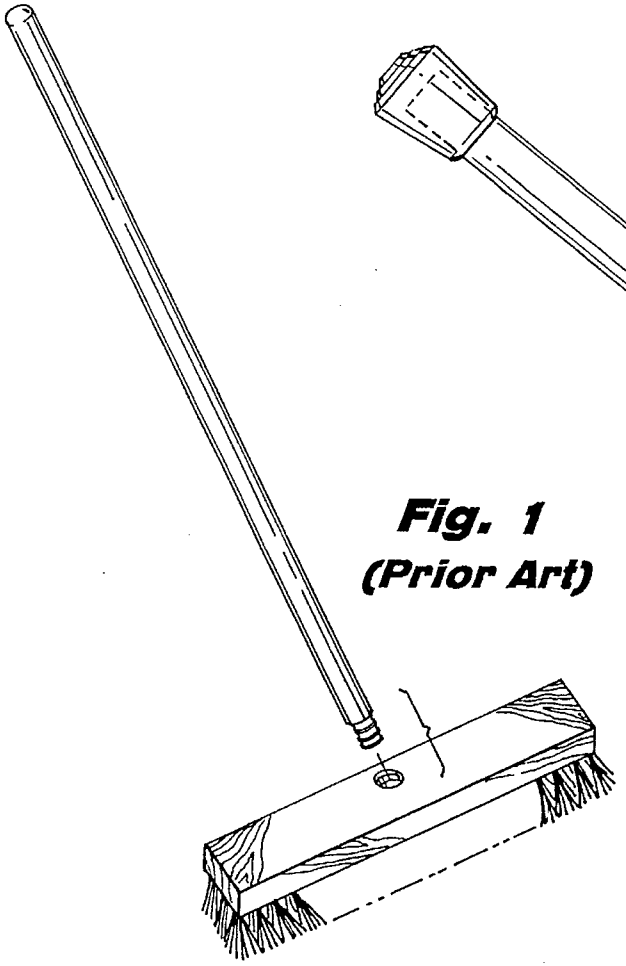
Fig. 1 (Prior Art)
FIG. 1 is a perspective view of a prior art push broom.
Figures 4, 5, 6:
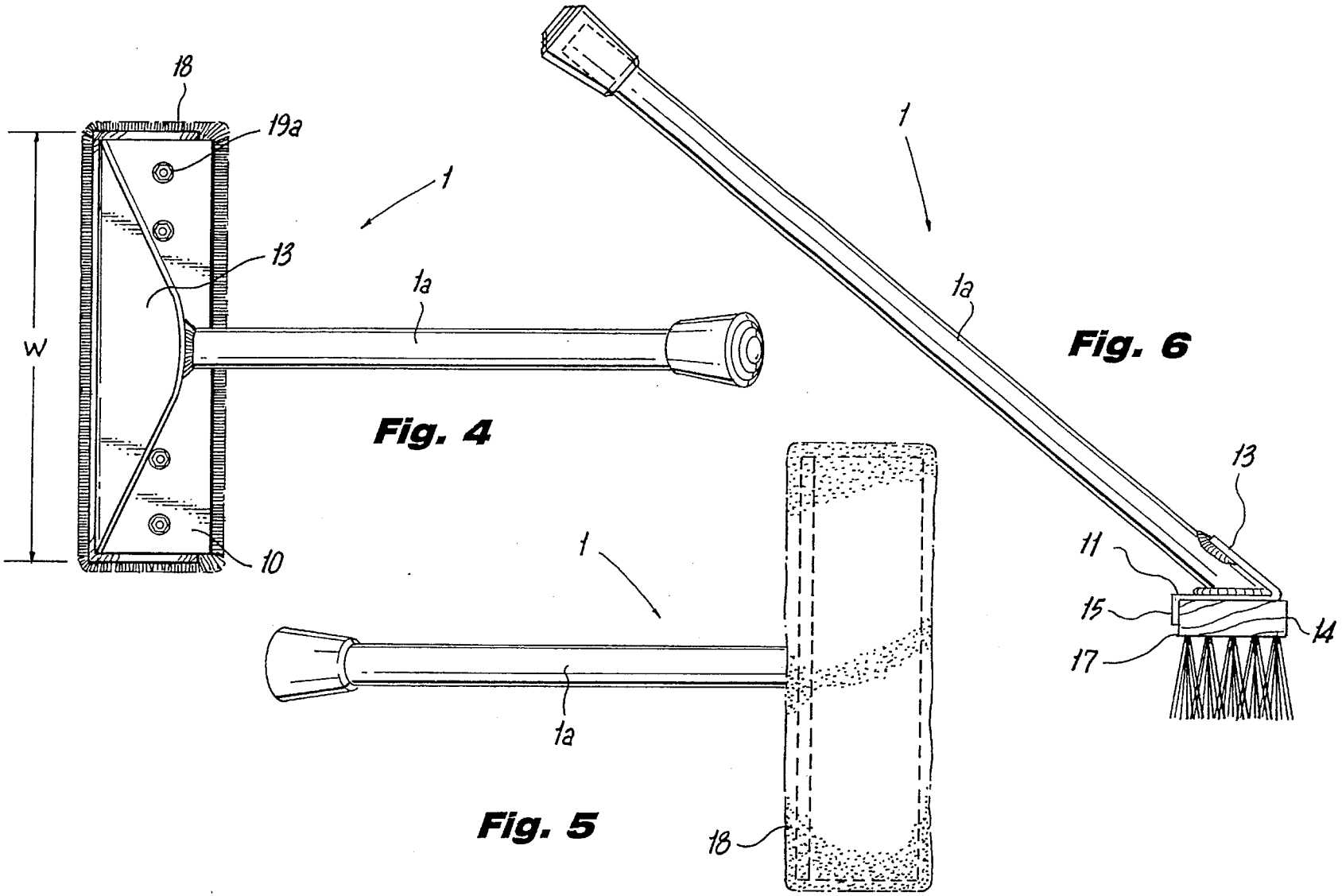
FIG. 4 is a top plan view thereof.
FIG. 5 is a bottom view thereof.
FIG. 6 is a left side elevational view thereof.
Figure 7:
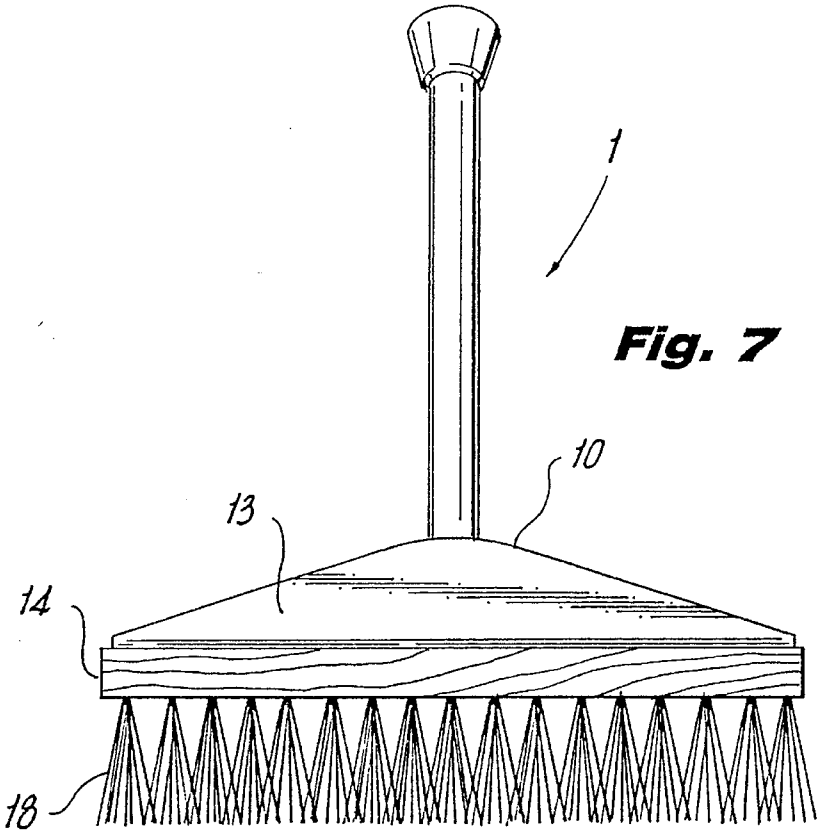
FIG. 7 is a front elevational view thereof.
Figure 8:
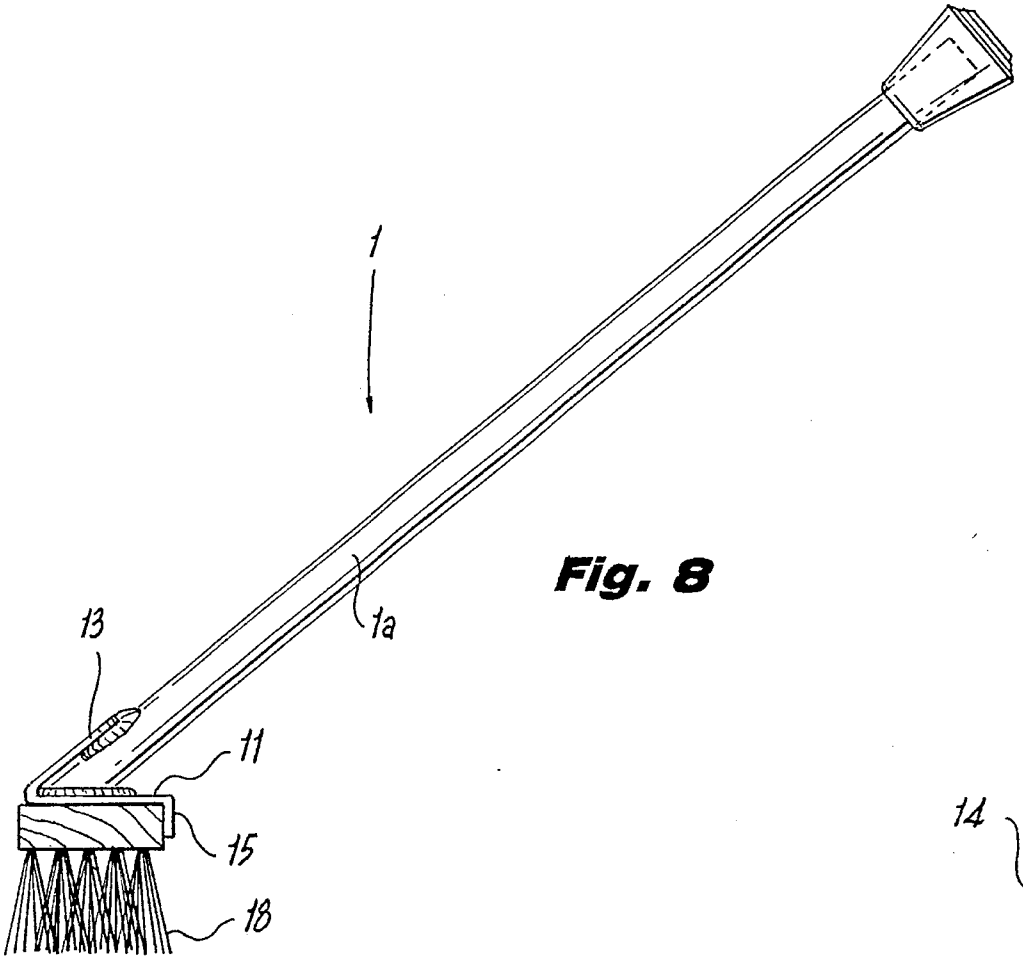
FIG. 8 is a right side elevational view thereof.

For comparison, FIG. 1 shows a perspective view of a prior art push broom.

In contrast, as shown in the drawing FIGS. 2–8, in preferred embodiment of the present invention, broom 1 includes fastener 10 having mid plate 11, which mid plate 11 is folded at an edge pleat 12 to first arcuate pleat member 13 in a angular position away from mid plate 11.

Furthermore, mid plate 11 is attachable to bristle block 14 and further a second folded reverse pleat member 15 is provided at edge 16 in a reverse direction from first pleat member 13, to provide a vertical wall abutting rear vertical face 17 of the bristle block 14.

Broom 1 is generally configured so that fastener 10 provides a positive lock against substantially all of the width of rear face 17 of bristle block 14 to facilitate the horizontal movement of broom 1 with bristle block 14 when sweeping. An advantage is to allow broom 1 to be pushed and maintained in a comfortable position without having the bristles 18 of bristle block 14 fold under themselves and rotate away from the user of broom 1.

Various embodiments of broom fastener 10 may be made of a variety of materials, such as hard plastic or steel. It should be appreciated that while the materials which are intended to be used can be adapted for use in the present invention, other embodiments may be made.

Fastener 10 is provided with first upward pleat member 13 to provide a position lock of rod la against bristle block 14 so that handle la can be firmly attached to bristle block 14, but wherein also further second pleat member 11 is provided behind bristle block 14, to facilitate a horizontal force against bristle block 14, for moving broom 1 in a horizontal longitudinal direction when broom 1 is being swept.

In addition, first upward pleat 13 of fastener 10 generally has a rounded upper edge 13*a*.

As used herein, the term "pleat" refers to relatively flat folded members 13, 15 formed in fastener 10, adjacent to mid plate 11. Reverse pleat member 15 serves the function of forming a pocket like recess for holding rear face 17 of bristle block 14 is to provide a horizontal force against bristle block 14 during sweeping.

As further shown in the drawing FIGS. 2–8, first arcuate pleat member 13 is created by folding a portion of fastener 10 up from mid plate portion 11 of fastener 10, to create arcuate plate member 13 having arcuate edge 13*a* on one side.

At other edge 16 of mid plate 11, mid plate 11 is folded to form second reverse pleat member 15, to create a downwardly extending portion abutting bristle block 14. Mid plate member 11 is folded against itself and the depth of reverse pleat member 15, as indicated by the arrow marked "D", is determined by the extent by which mid plate 11 of fastener 10, is folded back itself into reverse plate member 15. Plate member 15 may be in the range from ½ inch to about 1½ inches to provide a surface against which a horizontal force can be applied to substantially all of rear vertical wall 17 of bristle block 14.

As further shown in drawing FIGS. 2–8, reverse pleat member 15 is formed by folding the bottom 15*a* of one edge of reverse pleat member 15 towards the lower surface 11*a* of fastener mid plate 11. Mid plate 11 folded and then secured against bristle block 14 by depth "D". Therefore reverse pleat member 15 is formed on a portion of fastener 10 away from the forward first arcuate pleat member 13, which member 13 engages rod handle 1*a* within the recess provided between first arcuate folded pleat member 13 and mid plate 11 of fastener 10.

It may be desirable to increase the height "H" of first pleat member 13 and the depth "D" of reverse pleat member 15 respectively to accommodate different sized push brooms. It is most advantageous to increase the depth "D" of reverse pleat member 15 so as to increase horizontal force applied against vertical wall 17 of bristle block 14.

After pleated members 13, 15 are formed, fastener 10 is attached to bristle block 14 of broom 1 by fasteners 19, 19*a*, such as by nuts and bolts, wing nuts, screws or other fastener means.

Use of fastener 10 allows handle rod 1*a* to be easily attached to bristle block 14 in a permanent manner, which will not loosen. Furthermore, because of the extended width "W" reverse pleat member 15, the positive pushing force applied against block 14 facilitates its horizontal movement when a floor is swept by push broom 1.

In designing fastener 10, the characteristics of concern are the length, width and extendability of the plates 11, 13, 15 of fastener 10. However, the reverse pleat member 15 must be wide enough so that the sufficient force is exerted upon rear vertically face 17 of bristle block 14, to facilitate the horizontal movement of broom 1 along the surface of the floor ground being swept.

Furthermore, the width "W" of fastener 10 must be of a proper width so that horizontal force is applied against the substantially all of the portion of rear vertical wall 17 of bristle block 14, even though the initial force is applied downward by virtue of pushing handle 1*a* at an angular relationship against fastener 10 on top of bristle block 14.

Therefore, it is preferably to spread out the horizontal force applied against vertical wall 17 of bristle block 14, by widening fastener 10 to width "W" so that reverse pleat member 15 will substantially cover most of rear vertical wall 17 of bristle head 14.

Therefore, the comfort of the user may be greatly increased by having fastener 10 with a proper width "W", height "H" and depth "D".

By proper positioning the fastening of handle rod 1*a* to fastener 10, positive force is provided, not only by pushing along handle 1*a*, but also along rear vertical wall 17 of bristle block 14, which rear wall 17 contacts rear 15*a* of reverse pleat member 15, due to the effect of the force exerted.

Consequently, bristle block 14 is attached at a top portion 14*a* to lower surface 11*a* of mid plate 11 between first pleat member 13 and reverse pleat member 15, yet bristle block 14 is pushed substantially by not only the forward push against handle rod 1*a* by the user, but also by the transferred horizontal force against rear vertical wall 17 of reverse pleat member 15.

As shown in cross-section, fastener 10 is basically V-shaped in an essentially horizontally position, wherein one side of the "V" is horizontal and the other side is angular with respect to fastener 10.

An important function is to keep fastener 10 applied to the broom bristle head 14, so as to create a even force against not only top of bristle block 14, but also against the vertical rear face 17 of bristle block 14.

The principle purpose of the pleating arrangement of the first pleat member 13 and the reverse pleat member 15, serves to form a corner-like recess at a top of bristle block 14 respect to the handle, and at rear surface 17 of bristle block 14.

As mentioned previously, as shown in the drawing FIGS. 2–8, first arcuate pleat member 13 adjacent to mid plate 11 forms a pocket-like corner shape, to receive handle rod 1*a* at a central portion of fastener 10. The recess provided between mid plate 11 and reverse pleat member 15 provides a positive abutment against a rear wall 17 in a corner recess provided therein, so that reverse pleat 15 is tightly placed against bristle block 14.

Fastener 10 provided herein has the additional advantage so that when it is applied, broom 1 can be easily used while sweeping without fatigue on the arms, caused by constant folding in of bristles 18 due to the movement of bristles 18 and bristle head 14, when bristles 18 fold under each other at an end portion 18*a* touching the ground or floor, away from the user.

Broom handle fastener 10 of the present invention is easily fabricated to fit a wide variety of broom sizes. Further, the broom handle weighs less and is more compact than most of the prior art brooms and handles.

Furthermore, because fastener 10 incorporates the various unique pleating arrangements, broom 1 may be easily pushed in a horizontal direction without rotation of bristles 18, thus providing greater comfort for the user.

Unlike the prior art brooms which are attached only to a top portion of a broom bristle block, wherein the bristles tend to fold forward and away from the user, and unlike the brooms, such as in the prior art of Bauman, which are attached only at a rear corner, causing the bristle block 10 to rotate away from the user, the present invention applies force at both rear vertical wall 17 and also at top 14*a* of bristle block 14, to facilitate both the pulling of bristle block 14 from the front as well as pushing from the rear.

The invention described herein may be embodied in other specific forms without departing from the spirit and scope of the present invention. The present embodiment is described in all respects only illustrative, and is not restrictive. The scope of the invention is therefore indicated by the appended claims rather then by the forgoing description. Any changes which come within the meaning of the scope of the claims are to be embraced within their scope.

I claim:

1. A broom and handle combination comprising:

(a) an elongated rod handle portion having a distal end;

(b) a broom head portion comprising a block portion having a top portion and a bottom portion which has a plurality of bristles extending therefrom, the block portion further including a vertical face extending along the block portion and between the top and bottom portions;

(c) a fastener for connecting said handle and said broom head portion, said fastener comprising:

(i) a substantially planar mid plate portion having opposed edges along opposite sides thereof;

(ii) a first substantially planar pleat member extending above and from said mid plate portion along one of said edges, said first pleat member and said mid plate portion defining an acute angle therebetween in which the distal end of the handle is secured;

(iii) a second substantially planar pleat member extending below and from said mid plate portion along the other edge thereof and oriented substantially perpendicular to the mid plate portion; and (d) wherein the top portion of the broom head portion is secured to a bottom portion of said mid plate portion and said vertical face of the broom head portion contacts at least a portion of said second pleat member.

2. The broom and handle combination as set forth in claim 1 wherein said first pleat member includes an arcuate portion joinable at an apex thereof to a portion of said broom rod handle portion, wherein said broom rod handle portion extends along an axis extending in a direction away from said apex.

3. The broom and handle combination as in claim 1 wherein said second pleat member provides a wide abutment against substantially all of said verticle face of said block portion.

4. The broom and handle combination as in claim 1 wherein said first pleat member is folded at an angle away from said block portion and wherein said second pleat member is folded in a reverse direction from said first pleat member.

5. The broom and handle combination as in claim 1 wherein said pleated members of said fastener are folded such that said block portion is disposed away from said first pleat member and adjacent to said second pleat member, wherein said fastener has a V-shaped cross-sectional shape.

6. The broom and handle combination as in claim 1 wherein said second pleat member protrudes away from said mid plate portion of said fastener.

7. The broom and handle combination as in claim 1 wherein said mid plate portion is provided with a plurality of apertures for insertion of fastening means for fastening said block portion to said fastener of such broom and handle combination.

* * * * *